US005425003A

United States Patent [19]

Horn

[11] Patent Number: 5,425,003

[45] Date of Patent: Jun. 13, 1995

[54] ACOUSTIC TRANSDUCER MOUNTING CLAMP

[75] Inventor: Michael Horn, So. Setauket, N.Y.

[73] Assignee: Grumman Aerospace Corporation, Bethpage, N.Y.

[21] Appl. No.: 280,019

[22] Filed: Jul. 25, 1994

[51] Int. Cl.[6] ..... H04R 1/16; H04R 1/18

[52] U.S. Cl. ..... 367/191; 367/165; 367/173

[58] Field of Search ..... 367/165, 173, 191

[56] References Cited

U.S. PATENT DOCUMENTS

| | | | |
|---|---|---|---|
| 2,891,180 | 6/1959 | Elmore | 367/173 |
| 3,234,501 | 2/1966 | Hagen et al. | 367/191 |
| 3,272,000 | 9/1966 | Stebbins | 367/165 |
| 3,771,117 | 11/1973 | Shaffer et al. | 367/165 |
| 5,051,966 | 9/1991 | Gjestrum et al. | 367/153 |
| 5,186,428 | 2/1993 | Falkenburg | 248/284 |
| 5,371,719 | 12/1994 | Burn et al. | 367/173 |

*Primary Examiner*—Charles T. Jordan
*Assistant Examiner*—Christopher Keith Montgomery
*Attorney, Agent, or Firm*—Stetina Brunda & Buyan

[57] ABSTRACT

An acoustic transducer mounting clamp for holding an acoustic transducer against a test surface utilizing fatigue resistant adhesive so as to facilitate the use of a gel couplant at the interface of the transducer and the test surface. The clamp has a base adhesively bondable to the test surface with the fatigue resistant adhesive; and a holder formed to the base and configured to hold the acoustic transducer in contact with the test surface with gel couplant disposed at the interface of the transducer and the test surface. The fatigue resistant adhesive maintains positioning of the acoustic transducer in contact with the test surface and the gel couplant facilitates transmission of acoustic energy from the test surface to the acoustic transducer.

20 Claims, 1 Drawing Sheet

ACOUSTIC TRANSDUCER MOUNTING CLAMP

FIELD OF THE INVENTION

The present invention relates generally to acoustic instrumentation and more particularly to an acoustic transducer mounting clamp for holding an acoustic transducer against a test surface with fatigue resistant adhesive so as to facilitate the use of a gel couplant at the interface of the transducer and the test surface.

BACKGROUND OF THE INVENTION

The use of acoustic transducers in fatigue testing is well known. Typically, one or more piezo-electric acoustic transducers are attached to a test surface of an item subjected to such fatigue testing. The acoustic transducers provide test data regarding the acoustic energy emissions of the instrumented test surface.

However, it is not uncommon for acoustic transducers to become completely detached from the test surface being monitored during fatigue testing. Such debonding of the acoustic transducer typically occurs slowly such that the transducer does not exhibit evidence of the failing bond until the signal provided by the transducer has degraded substantially. As a result, there is steady degradation of the acoustic transducer's adhesive bond and a consequent incremental loss of data quality prior to complete failure of the adhesive bond. It is also thought that such debonding or gradual failure of the adhesive bonding agent may introduce spurious transient or cracking signals, thereby rendering the data provided by the transducer unreliable.

Thus, one of the problems commonly associated with the use of such acoustic transducers during fatigue testing includes degradation and/or failure of the adhesive with which the piezo-electric transducers are attached to the test surface and the consequent inability of the failed adhesive to adequately transmit acoustic energy from the test surface to the acoustic transducer.

Additionally, a tradeoff exists between fatigue resistance and acoustic transmission capability in the use of the various coupling and adhesive bonding agents. Those materials which provide desirable acoustic coupling properties typically provide poor bonding properties and vice versa. Thus, those adhesives which are most likely to withstand the stress associated with fatigue testing do not transmit acoustic energy well. Conversely, gel couplants, which transmit acoustic energy well, do not provide a bond having sufficient strength to adhesively bond acoustic transducers in place during fatigue testing.

Thus, although gel couplants have desirable acoustic transmission properties, such gel couplants are not capable of mounting an acoustic transducer to a test surface, and conversely, various adhesives have the desired fatigue resistant properties, but lack the acoustic transmission ability of gel couplants. As such, according to contemporary methodology, the effectiveness of acoustic energy transmission is compromised by utilizing adhesive bonding agents having the required fatigue resistant qualities, but lacking the desired acoustic energy transmission properties.

As such, although the use of such fatigue resistant adhesive bonding agents has proven generally suitable for the mounting of acoustic transducers, the use of such fatigue resistant bonding agents possesses inherent deficiencies which detract from their overall performance and desirability. In view of the shortcomings of the prior art, it is desirable to provide a means whereby acoustic transducers are mounted to a test surface in a manner which does not subject them to the undesirable effects of fatigue and which also provides the desired acoustic transmission of gel couplants.

SUMMARY OF THE INVENTION

The present invention specifically addresses and alleviates the above-mentioned deficiencies associated with the prior art. In its broadest aspect, the present invention comprises a clamp or means for holding an acoustic transducer in contact with a test surface, wherein the means is rigidly attached to the test surface and compressively contacts or abuts the acoustic transducer so as to facilitate the use of a gel couplant to maintain desired acoustic coupling between the acoustic transducer and the test surface.

More particularly, the present invention comprises an acoustic transducer mounting clamp for holding an acoustic transducer against a test surface utilizing fatigue resistant adhesive at the interface of the clamp and the test surface and utilizing a gel couplant at the interface of the transducer and the test surface. The clamp comprises a base adhesively bondable to the test surface with the fatigue resistant adhesive and a transducer holder formed to the base to hold the acoustic transducer in contact with the test surface. The holder preferably abuts the acoustic transducer and applies a compressive force thereto, so as to urge the acoustic transducer into intimate contact with the test surface. Gel couplant is disposed at the interface of the transducer and the test surface.

The fatigue resistant adhesive thus maintains positioning of the acoustic transducer in contact with the test surface, i.e., via the clamp, and the gel couplant provides the desired transmission of acoustic energy from the test surface to the acoustic transducer.

The transducer holder of the claim preferably comprises at least one resilient attachment member for maintaining the position of the acoustic transducer relative to the clamp. The attachment member preferably comprises a sheet of polymer material interconnecting the acoustic transducer and the clamp. The transducer holder also preferably comprises a resilient damper which abuts the acoustic transducer so as to urge the acoustic transducer into contact with the test surface.

The base and the transducer holder of the clamp are preferably comprised of a single piece of metal having a generally Z-shaped configuration wherein the two horizontal portions of the Z are approximately perpendicular to the vertical portions thereof.

An IC holder is optionally formed upon the base. The IC holder is preferably configured to hold an IC having signal conditioning electronics, e.g., a pre-amp, filter, etc., disposed therein.

A first electrical connector formed upon the base facilitates electrical communication between the acoustic transducer and the IC. A second electrical connector formed upon the base and in electrical communication with the IC provides an output for the acoustic transducer and/or the IC. Thus, the acoustic transducer can preferably be plugged into the first electrical connector and the output thereof taken from the second electrical connector whether or not an IC is present in the IC holder.

The clamp preferably comprises a single piece of sheet metal having a generally Z-shaped configuration defining an upper member, an intermediate member, and a lower member. The lower member defines the base while the intermediate and upper members define the transducer holder.

The resilient damper is formed upon the under surface of the upper member so as to abut the acoustic transducer and urge the acoustic transducer toward the test surface. The clamp thus applies a compressive force, via the resilient damper, to the acoustic transduce so as to maintain the desired contact of the acoustic transducer with the test surface. The resilient attachment member is preferably formed upon the intermediate member so as to maintain the position of the acoustic transducer relative to the clamp. The IC holder, first, and second electrical connectors are preferably formed as a unitary assembly upon the lower member.

Thus, the clamp, preferably the lower member thereof, is attachable to the test surface via a fatigue resistant adhesive so as to facilitate the use of a gel couplant at the interface of the acoustic transducer and the test surface. In this manner, acoustic transmission from the test surface to the acoustic transducer is enhanced and fatigue resistant mounting of the acoustic transducer is provided.

Those skilled in the art will recognize that various fatigue resistant adhesives and gel couplants are suitable for use in the present invention.

The acoustic transducer mounting clamp of the present invention furthermore facilitates attachment of an acoustic transducer to a test surface without requiring modification of the test surface, i.e., drilling and tapping of a hole in the test surface such that the transducer can be threadably attached thereto. Thus, the test surface need not be modified so as to provide attachment of the acoustic transducer to the test surface in a manner which assures both reliable attachment and adequate acoustic coupling.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

Figure 1:
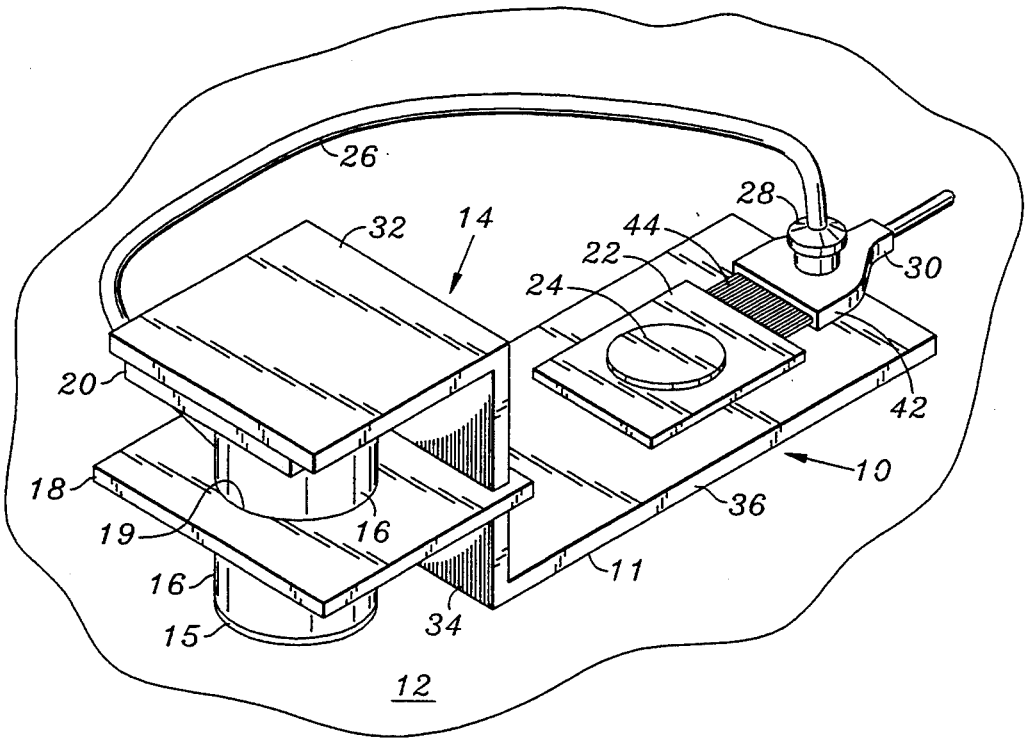
FIG. 1 is a perspective view of the acoustic transducer mounting clamp of the present invention having an acoustic transducer and an IC mounted thereto.

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The acoustic transducer mounting clamp of the present invention is illustrated in FIG. 1 which depicts a presently preferred embodiment of the invention. Referring now to FIG. 1, the acoustic transducer mounting clamp is comprised of a base 10 adhesively bondable to a test surface 12 at the interface 11 of the base 10 and the test surface 12 with fatigue resistant adhesive, and a transducer holder 14 formed to the base and configured to hold an acoustic transducer 16 in contact with the test surface 12 utilizing a gel couplant disposed at the interface 15 of the transducer 16 and the test surface 12.

Examples of such fatigue resistant adhesives include dental cement and cyanoacrylate. Those skilled in the art will appreciate that other adhesive bonding agents are likewise suitable.

The fatigue resistant adhesive is disposed intermediate the base 10 and the test surface 12 at the interface 11 thereof and maintains positioning of the clamp so as to likewise maintain positioning of the acoustic transducer 16 in contact with the test surface 12. The gel couplant disposed at the interface 15 of the acoustic transducer 16 and the test surface 12 provides the desired transmission of acoustic energy from the test surface 12 to the acoustic transducer 16. The transducer holder 14 preferably comprises at least one resilient attachment member 18, for maintaining the position of the acoustic transistor 16 relative to the clamp. The attachment member 18 preferably comprises a sheet of an elastomeric polymer material, such as rubber, which is attached to both the transducer holder 14 and the acoustic transducer 16. The attachment member is preferably attached to the transducer holder 14 via adhesive bonding. Those skilled in the art will recognize that various other attachment means, e.g., ultrasonic bonding, thermal bonding, etc., are likewise suitable for attaching the attachment member 18 to the transducer holder 14. The attachment member 18 is preferably attached to the acoustic transducer 16 via a press fit wherein an aperture 19 formed within the attachment member 18 is elastically expanded so as to receive the acoustic transducer 16 and to subsequently elastically contract thereabout.

The transducer holder 14 preferably further comprises a resilient damper 20 which is disposed intermediate the upper member 32 and the ultrasonic transducers 16 and which abuts the upper surface of the acoustic transducer 16 so as to urge the acoustic transducer 16 into firm contact with the test surface 12. The damper 20 preferably comprises an elastomeric polymer material similar to that of the attachment member 18 and is preferably attached to the transducer holder 14 in a similar manner.

An IC holder 22 is preferably formed upon the base 10 such that an IC 24, preferably containing signal conditioning circuitry, is attachable thereto. A conductive conduit 26 extends from the acoustic transducer 16 to a first connector 28 which plugs into a corresponding connector formed upon a body 42 formed upon the base 10 to provide electrical communication from the acoustic transducer 16 to the integrated circuit 24 and/or a second connector 30. The second connector 30 is similarly plugged into a corresponding connector formed upon a body 42 upon the base 10 and provides for output of the acoustic transducer 16 and/or integrated circuit 24. Conductive conduits 44 provide electrical communication between the first and second connectors 28 and 30, respectively, and the IC 24.

Thus, a section of sheet metal is preferably formed to have a Z-shaped configuration defining an upper member 32, an intermediate member 34, and a lower member 36. The resilient damper 20 is preferably formed upon an under surface of the upper member 32 so as to abut the acoustic transducer 16 and thereby urge the acoustic transducer 16 into contact with the test surface 12. The resilient attachment member 18 is preferably formed upon the intermediate member 34 so as to maintain the position of the acoustic transducer 16 relative thereto.

Thus, the method for attaching an acoustic transducer to a test surface according to the present invention comprises the steps of resiliently attaching the acoustic transducer to a mounting clamp, attaching the mounting clamp to the test surface with a fatigue resistant adhesive, and acoustically coupling the acoustic transducer to the test surface with a gel couplant. The gel couplant is applied to the test surface contacting portion of the acoustic transducer prior to attaching the mounting clamp to the test surface. The mounting clamp applies a compressive force to the acoustic transducer to urge it into firm contact with the test surface.

It is understood that the exemplary acoustic transducer mounting clamp described herein and shown in the drawings represents only a presently preferred embodiment of the invention. Indeed, various modifications and additions may be made to such embodiment without departing from the spirit and scope of the invention. For example, various configurations of the clamp are contemplated. Those skilled in the art will recognize that the clamp may be formed of various different materials and by various different methods. Also, various means for attaching the acoustic transducer to the clamp are likewise contemplated. Thus, these and other modifications and additions may be obvious to those skilled in the art and may be implemented to adapt the present invention for use in a variety of different applications.

What is claimed is:

1. An acoustic transducer mount for holding an acoustic transducer against a test surface, the mount comprising:

a) a clamp rigidly attachable to the test surface, said clamp applying a compressive force to the acoustic transducer such that the position of the acoustic transducer is maintained when a gel couplant is disposed at the interface of the acoustic transducer and the test surface;

b) wherein use of the gel couplant enhances acoustic energy transmission from the test surface to the acoustic transducer.

2. The acoustic transducer mount as recited in claim 1 wherein said clamp is adhesively bondable to the test surface so as to eliminate a need to modify to the test surface.

3. The acoustic transducer mount as recited in claim 1 further comprising a resilient attachment member formed to said clamp for maintaining the position of the acoustic transducer relative to said clamp.

4. The acoustic transducer mount as recited in claim 1 further comprising a resilient damper disposed intermediate the acoustic transducer and said clamp and abutting the acoustic transducer so as to apply a compressive force thereto so as to urge the acoustic transducer toward the test surface.

5. An acoustic transducer mounting clamp for holding an acoustic transducer against a test surface using a gel couplant at an interface of the transducer and the test surface, said clamp comprising:

a) a base rigidly attachable to the test surface via fatigue resistant adhesive; and b) a holder formed to said base and configured to hold the acoustic transducer in contact with the test surface, with the gel couplant disposed at the interface of the transducer and the test surface;

c) wherein the fatigue resistant adhesive maintains positioning of the acoustic transducer in contact with the test surface and the gel couplant provides transmission of acoustic energy from the test surface to the acoustic transducer.

6. The acoustic transducer mounting clamp as recited in claim 5 wherein said holder comprises at least one resilient attachment member for maintaining the position of the acoustic transducer relative to said holder.

7. The acoustic transducer mounting clamp as recited in claim 5 wherein said base and said holder are comprised of a single piece of metal having a generally Z-shaped configuration.

8. The acoustic transducer mounting clamp as recited in claim 5 wherein said holder further comprises a resilient damper, the damper abutting the acoustic transducer so as to urge the acoustic transducer toward the test surface.

9. The acoustic transducer mounting clamp as recited in claim 5 further comprising an IC holder formed upon said base.

10. The acoustic transducer mounting clamp as recited in claim 5 further comprising a first electrical connector to which the acoustic transducer is attachable and a second electrical connector in electrical connection with the first electrical connector to which an output cable is attachable.

11. The acoustic transducer as recited in claim 8 wherein the said damper comprises an elastomeric polymer.

12. An acoustic transducer mounting clamp for holding an acoustic transducer against a test surface with fatigue resistant adhesive so as to facilitate the use of a gel couplant at an interface of the transducer and the test surface, said clamp comprising:

a) a section of sheet metal having a generally Z-shaped configuration defining an upper member, an intermediate member, and a lower member;

b) a resilient damper formed upon an under surface of said upper member so as to abut the acoustic transducer and urge the acoustic transducer toward the test surface;

c) a resilient attachment member formed upon said intermediate member so as to maintain position of the acoustic transducer relative to the intermediate member;

d) an IC holder formed upon said lower member for holding an IC comprising signal conditioning circuitry; and e) first and second electrical connectors formed upon said lower member, said first electrical connector for providing electrical communication between the acoustic transducer and the IC, the second electrical connector for providing an electrical output from the IC;

f) wherein said lower member is attachable to the test surface via fatigue resistant adhesive so as to facilitate the use of a gel couplant at an interface of the acoustic transducer and the test surface.

13. An acoustic transducer and mounting clamp assembly for measuring acoustic energy at a test surface, the assembly comprising:

a) an acoustic transducer; and b) a clamp, said clamp comprising:

i) a base adhesively bondable to the test surface with a fatigue resistant adhesive; and ii) a holder formed to said base and configured to hold the acoustic transducer in contact with the test surface, with a gel couplant disposed at an interface of the transducer and the test surface;

iii) wherein the fatigue resistant adhesive maintains positioning of the acoustic transducer in contact with the test surface and the gel couplant provides transmission of acoustic energy from the test surface to the acoustic transducer.

14. The assembly as recited in claim 13 wherein said holder comprises at least one resilient attachment member for maintaining the position of the acoustic transducer relative to said holder.

15. The assembly as recited in claim 13 wherein said base and said holder are comprised of a single piece of metal having a generally Z-shaped configuration.

16. The assembly as recited in claim 13 wherein said holder further comprises a resilient damper, the damper abutting the acoustic transducer so as to urge the acoustic transducer toward the test surface.

17. The assembly as recited in claim 13 further comprising an IC holder formed upon said base.

18. The assembly as recited in claim 13 further comprising a first electrical connector to which the acoustic transducer is attachable and a second electrical connector in electrical connection with the first electrical connector to which an output cable is attachable.

19. An acoustic transducer and mounting clamp assembly for measuring acoustic energy at a test surface, the assembly comprising:

a) an acoustic transducer; and b) a mounting clamp, said clamp comprising:

i) a section of sheet metal having a generally Z-shaped configuration defining an upper member, an intermediate member, and a lower member;

ii) a resilient damper formed upon an under surface of said upper member so as to abut the acoustic transducer and urge the acoustic transducer toward the test surface;

iii) a resilient attachment member formed upon said intermediate member so as to maintain position of the acoustic transducer relative to the clamp;

iv) an IC holder formed upon said lower member for holding an IC comprising signal conditional circuitry; and v) first and second electrical connectors formed upon said lower member, said first electrical connector for providing electrical communication between the acoustic transducer and the IC, the second electrical connector for providing an electrical output from the IC;

vi) wherein said lower member is attachable to the test surface via fatigue resistant adhesive so as to facilitate the use of a gel couplant at an interface of the acoustic transducer and the test surface.

20. A method for attaching an acoustic transducer to a test surface, the method comprising the steps of:

a) resiliently attaching the acoustic transducer to a mounting clamp;

b) attaching the clamp to the test surface with a fatigue resistant adhesive; and c) acoustically coupling the acoustic transducer to the test surface with a gel couplant.

* * * * *